US005978960A

United States Patent [19]

Wrightman

[11] Patent Number: 5,978,960

[45] Date of Patent: Nov. 9, 1999

[54] ADJUSTABLE DRY SUIT AND SEALING SYSTEM THEREFORE

[76] Inventor: Ronald A. Wrightman, Box 25, 1 Kevin Cresent, Bracebridge, Ontario P1L 1A7, Canada

[21] Appl. No.: 08/797,645

[22] Filed: Jan. 31, 1997

[51] Int. Cl.[6] ..... A41D 7/00

[52] U.S. Cl. ..... 2/2.15; 2/270

[58] Field of Search ..... 2/2.15, 2.16, 2.17, 2/79, 82, 129, 135, 158, 159, 161.1, 162, 227, 311, 312, 369, 270, 914, 919, 50, 169; 63/3, 5.1, 6, DIG. 2, DIG. 3; 450/120, 134, 136, 137

[56] References Cited

U.S. PATENT DOCUMENTS

| | | | |
|---|---|---|---|
| 1,503,117 | 7/1924 | Crawford et al. | 2/50 |
| 1,935,504 | 11/1933 | Hargreaves | 63/3 X |
| 3,725,173 | 4/1973 | Johnson et al. | 2/2.15 X |
| 3,811,132 | 5/1974 | Seganzac et al. | 2/270 |
| 4,015,295 | 4/1977 | Lancaster et al. | 2/2.15 |
| 4,034,416 | 7/1977 | Buffkin et al. | 2/2.15 |
| 4,197,720 | 4/1980 | Nani | 63/3 X |
| 4,547,904 | 10/1985 | Lomg et al. | 2/135 X |
| 4,893,358 | 1/1990 | Bice | 2/919 X |
| 5,628,067 | 5/1997 | Meyer et al. | 2/270 X |
| 5,630,229 | 5/1997 | Machado et al. | 2/2.15 |

OTHER PUBLICATIONS

Gershman, Maurice, Journal of the American Medical Association, vol. 168, No. 7, Self Adhering Nylon Tapes, Oct. 1958.

*Primary Examiner*—John J. Calvert
*Assistant Examiner*—Shirra L. Jenkins
*Attorney, Agent, or Firm*—Ladas & Parry

[57] ABSTRACT

A dry suit has an outer garment of waterproof material. The fit of the garment is adjusted by pleating the garment and securing the pleat with "Velcro" fasteners spaced apart on the garment. A seal is provided at the neck, wrists and ankles by a cuff overlapping the garment on a support ring and secured with a resilient band.

7 Claims, 9 Drawing Sheets

ADJUSTABLE DRY SUIT AND SEALING SYSTEM THEREFORE

The present invention relates to dry suits.

For people engaged in aquatic activities, such a diving, sailing or sailboarding it is frequently necessary to provide protection against the ambient temperature of the water. Typically, protection is provided by means of a wet suit in which a thin film of water is trapped within a foam layer next to the body so that a relatively stable layer of insulation is provided. In more arduous environments, the insulation provided by the wet suit is insufficient and accordingly dry suits have been developed that provide additional protection.

A dry suit is essentially a waterproof garment that allows the user to wear conventional insulating clothing within the garment. This allows the amount of clothing to be adjusted to suit the ambient conditions.

To accommodate the varying thickness of clothing, the dry suits tend to be relatively loose fitting. Elastic cords are incorporated into the outer garment to snug the suit to the user's body, but nevertheless the suit tends to be bulky and is not generally considered to be practical for summer use.

Entry to the dry suit is typically provided a zippered opening which must of course be waterproof when closed. As such the zippers tend to be relatively expensive and frequently require replacement to avoid leakage.

An alternative approach to avoid the use of a zipper is to provide an access hole in the back of the dry suit with sufficient material around the hole to allow it to be rolled up and tied to form a seal. This arrangement, however, interferes with the installation of ancillary equipment such as air tanks and also requires assistance to seal and unseal. A further deficiency associated with the prior suits is the installation of a seal between the feet, wrist and neck. These conventionally are resilient cuffs or boots that are permanently attached to the suit and therefore prone to tearing when the suit is being put on. A tear in the suit does of course require immediate repair which may not always be convenient.

It is therefore an object of the present invention to provide a dry suit in which the above disadvantages are obviated or mitigated.

In general terms, according to one aspect of the invention there is provided an outer garment for a dry suit that comprises a plurality of tubular portions interconnected to define a body, arms and legs for the suit. At least one of the tubular portion has a pair of circumferentially spaced fastenings that are interengagable to establish a pleat in the garment. The diameter of the tubular portion may thus be reduced and a snug fit provided for the suit.

Preferably, the fastenings are positioned on each of the tubular portions and preferably are in the form of hook and loop closure systems, conventionally referred to as Velcro fasteners, to allow for adjustment of the suit over an extended range.

According to a further aspect of the invention, a dry suit includes an outer garment with plurality of tubular portions interconnected to provide a body, a pair of arms, a pair of legs and a neck opening. The seal is located at a distal end of one of the tubular portions and includes a support ring having an inner diameter to permit passage of a body portion of a user through the ring. The ring also has an outer surface to provide a sealing surface to the distal end of one of the tubular members and a flexible cuff is supported by the support ring and extends radially inwardly to engage resiliently with the body portion. The cuff and support ring cooperate with the distal end of the tubular member to inhibit ingress or passage of water past the body portion and into the outer garment.

The support ring is detachable from the tubular member and thereby allows the suit to be fitted without imposing significant strain upon the seal member.

Preferably, the cuff and distal end of the tubular portion overlap on the outer surface of the ring to provide a layered seal therebetween.

An embodiment to the invention will now be described by way of example only and with reference to accompanying drawings, in which FIG. 1 is a perspective view of an outer garment for dry suit;

Figure 1:
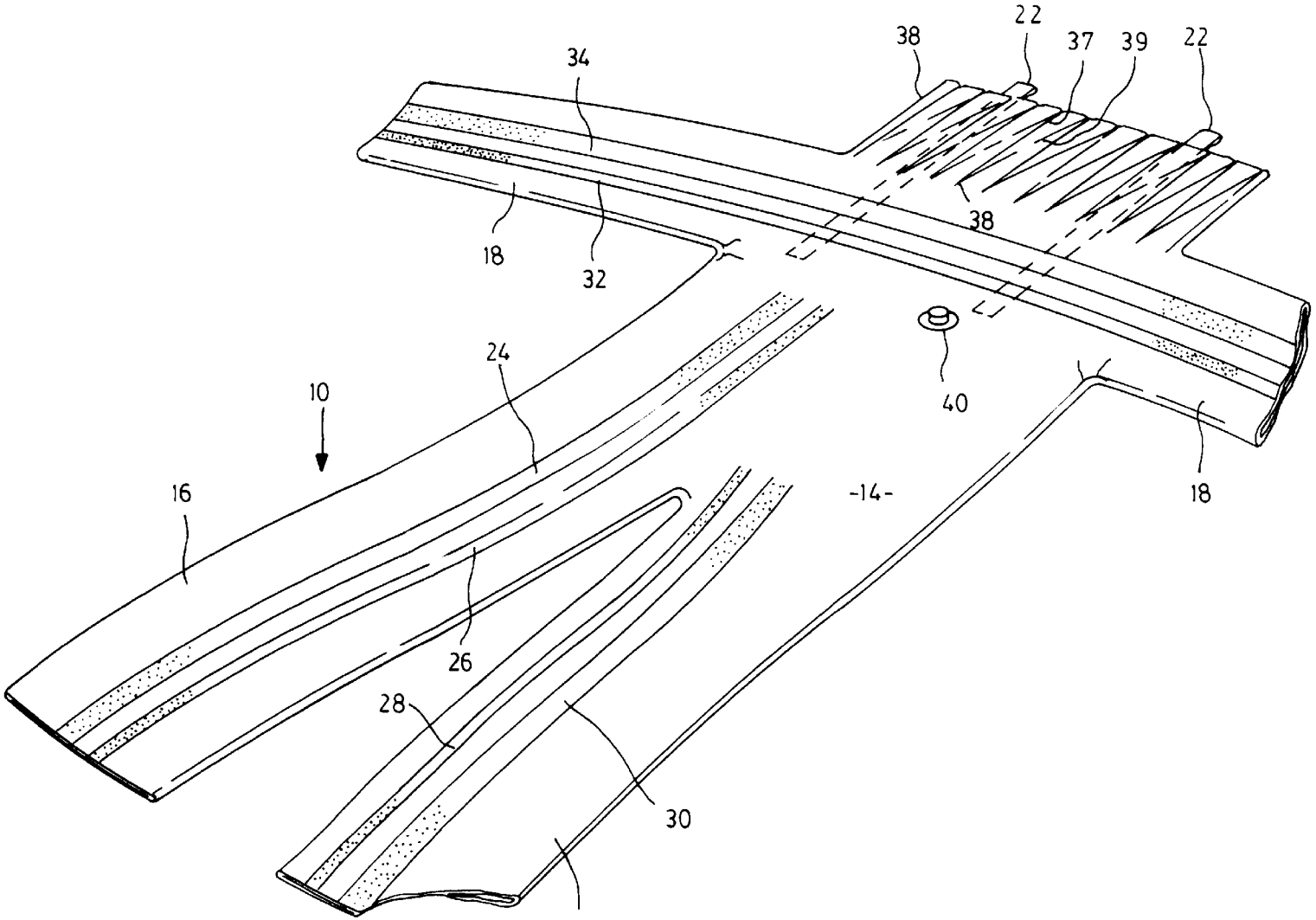
Figure 3:
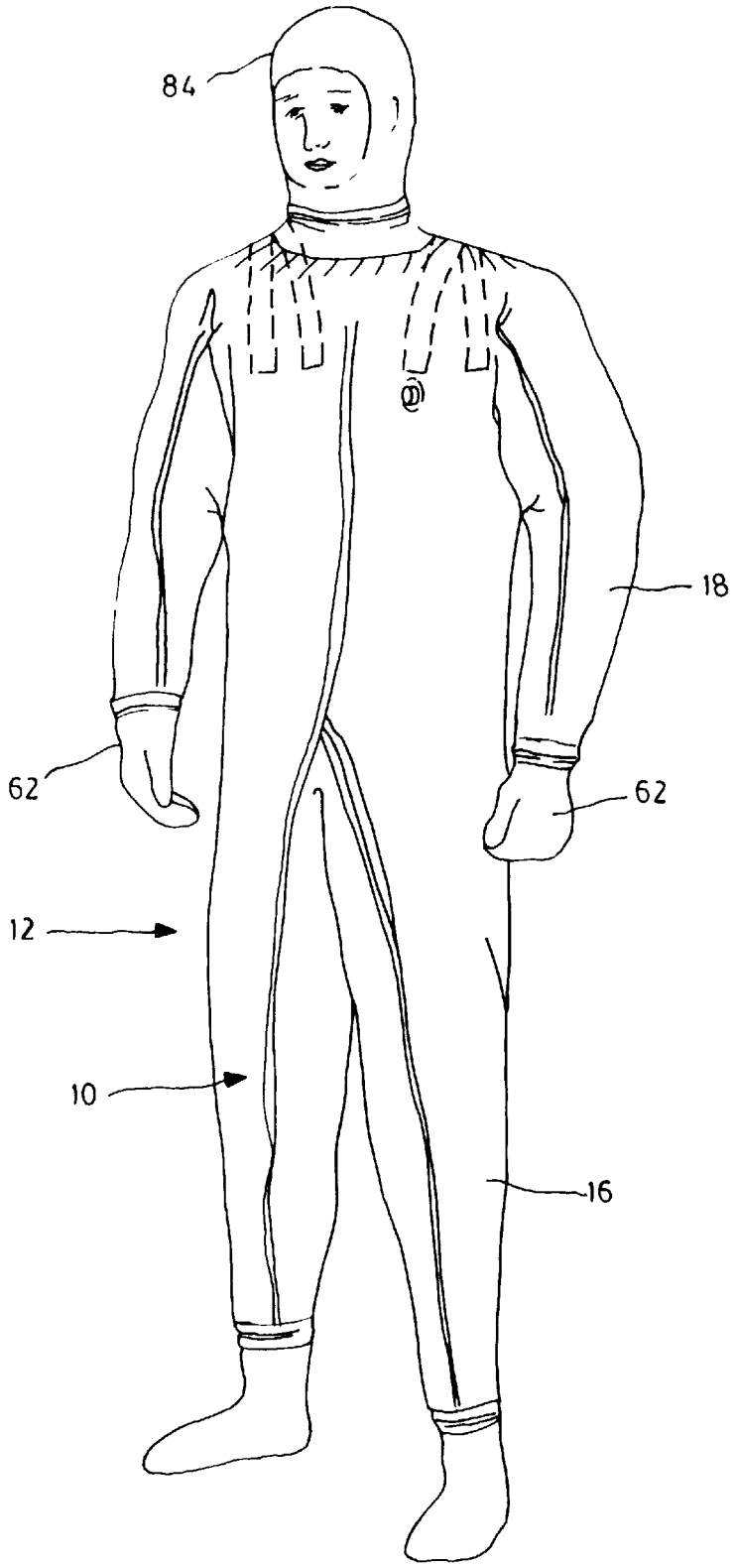
FIG. 3 is a view similar to FIG. 2 showing the complete dry suit with the extremities of the user covered.

Referring therefore to FIG. 1, there is shown an outer garment 10 for a dry suit generically indicated 12 in FIG. 3. The outer garment 10 is made from a waterproof flexible material such as is conventionally used in dry suits and is formed as a single unitary article with appropriate waterproof sealant.

The outer garment 10 comprises a control tubular portion 14 that constitutes the body 14 of the garment and a pair of depending tubular portions that constitute the legs 16. Lateral tubular portions project laterally from the upper portion of the body 14 to provide the arms 18 for the garment 10. A tubular portion projects upwardly from the body 14 above the arms 18 and provides a neck opening 20 of the same diameter as the body 14 to allow ingress and egress from the outer garment 10. A pair of suspenders 22 are secured to the body 14 to pass over the shoulders of the user and support the outer garment 10.

A pair of tapes 24, 26 extend along the body 14 and one of legs 16 in spaced parallel relationship. The tapes 24, 26 provide a hook and loop fastener system, typically referred to as a Velcro fastener, with one of the tapes 24 providing an array of loops and the other tape 26 providing an array of flexible hooks. It will be noted that the tape 26 is somewhat narrower than that of tape 24 so that the tapes can be interengaged in one of a number of lateral positions.

Similarly, a pair of tapes 28, 30 are secured to the other leg 16 in spaced parallel relationship and tapes 32, 34 are also provided across each of the arms 18 and across the chest of the body 14.

The neck opening 20 is formed with a series of triangular pleats 36 having crease lines 37, 39 which extend from an apex 38 adjacent to the body 14 to the distal end of the tubular member.

An inflation valve 40 of known construction is also provided in the body 14 to allow air to be pumped into the garment 10 to increase the buoyancy.

Figure 2:
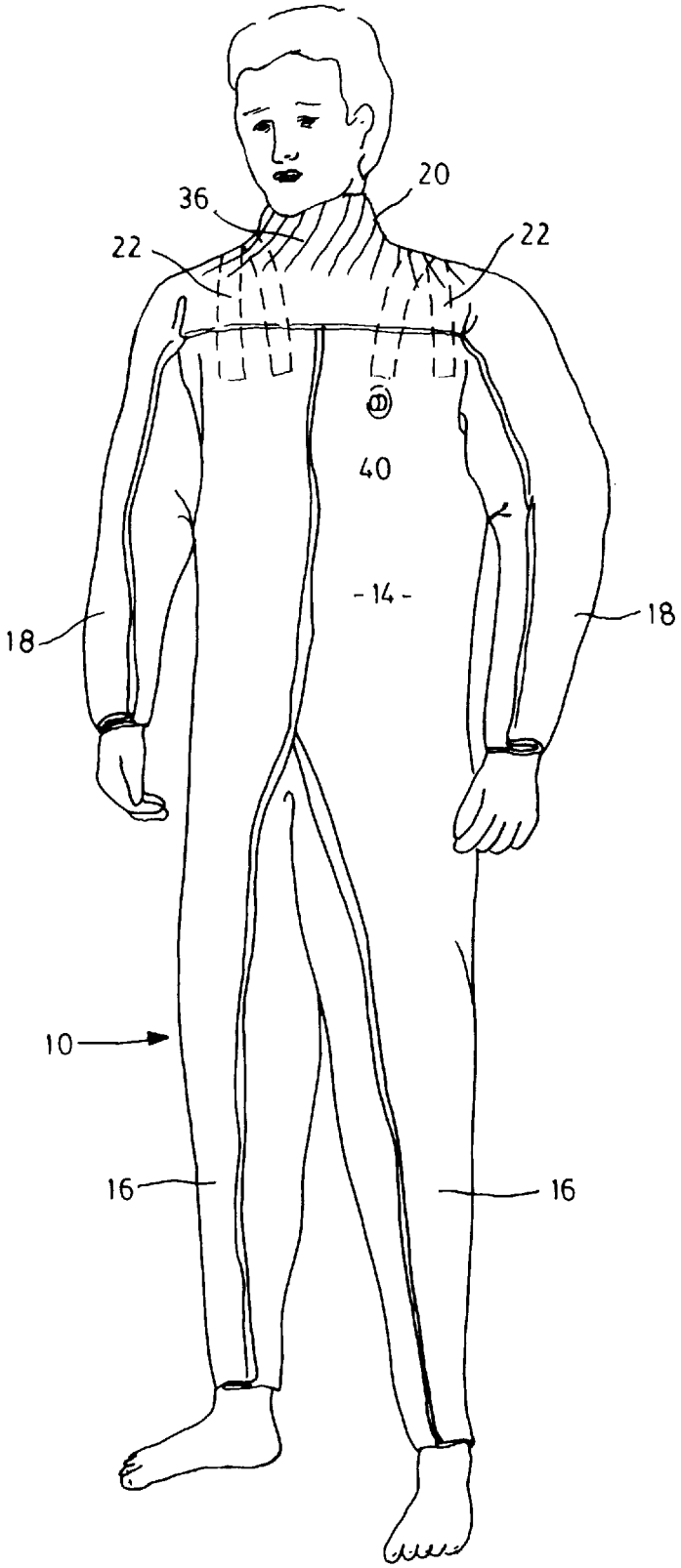
FIG. 2 is a view showing a user wearing the garment in FIG. 1.

As can be seen from FIG. 2, the outer garment 10 is put on by the user by stepping through the neck opening 20. The legs and arms are of course placed in respective tubular portions with the feet and hands projecting through the distal extremities of the garment. The braces 22 are adjusted on the shoulders to maintain the garment at the requisite position.

Figure 5:
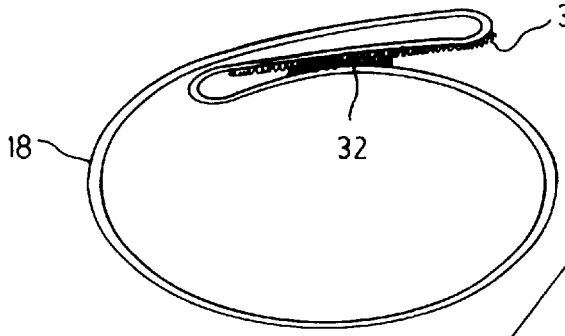
FIG. 5 is a view in the direction of arrow 5 in FIG. 4.

Once the user has installed the garment 10, the arms 18, legs 16 and body 14 may be adjusted to fit the user by forming a pleat in the respective tubular portions. As can be seen in FIG. 5, the arm 18 may be folded or pleated so that the tape 34 is directed toward the tape 32 and can be engaged to retain the pleat in the desired position. The pleating of the arm 18 reduces its diameter and so allows a snug fit against the arms of the user. The increased width of the tape 34 allows adjustment along the length arms 18 for a properly contoured fit.

Similarly, the leg 16 and body 14 may be adjusted by folding the garment such that the tape 24 overlies the tape 26. Again adjustment is provided due to the difference in widths of the tapes so that they snug fit around the body and the leg is obtained. In a similar manner, the tapes 30 and 28 may be used to adjust the diameter of the leg 16 so that the comfortable fit is obtained.

The pleats 36 form a generally conical closure for the neck opening 20 so that the excess material around the neck is distributed in even orderly manner. The pleats in the neck opening do not take any vertical load due to the provision of the suspenders 22. As such the pleats are free to adopt an orderly arrangement without undue loads being place upon them.

Figure 4:
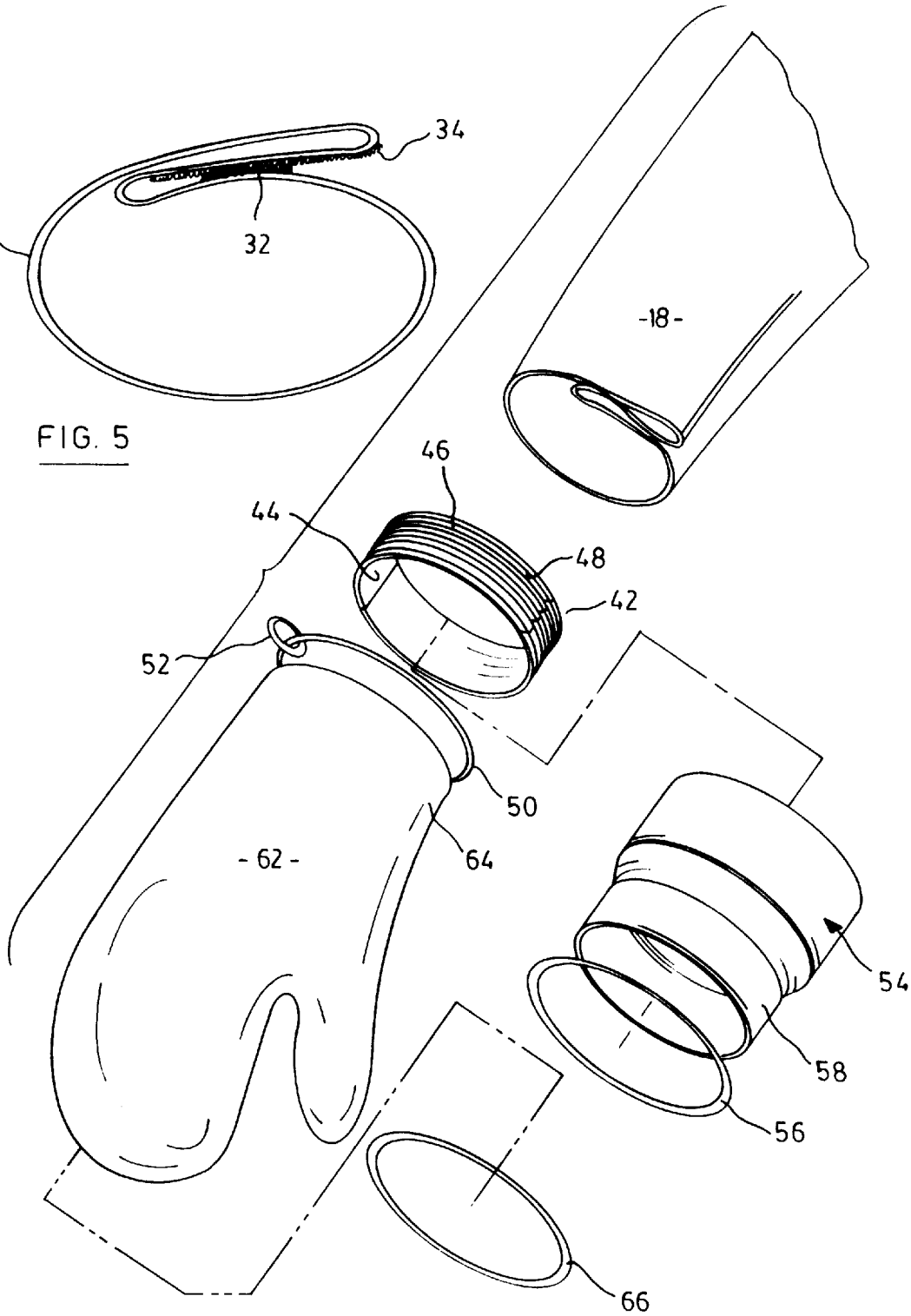
FIG. 4 is an exploded perspective view of a seal formed at the hand of the user of FIG. 3.
Figure 6:
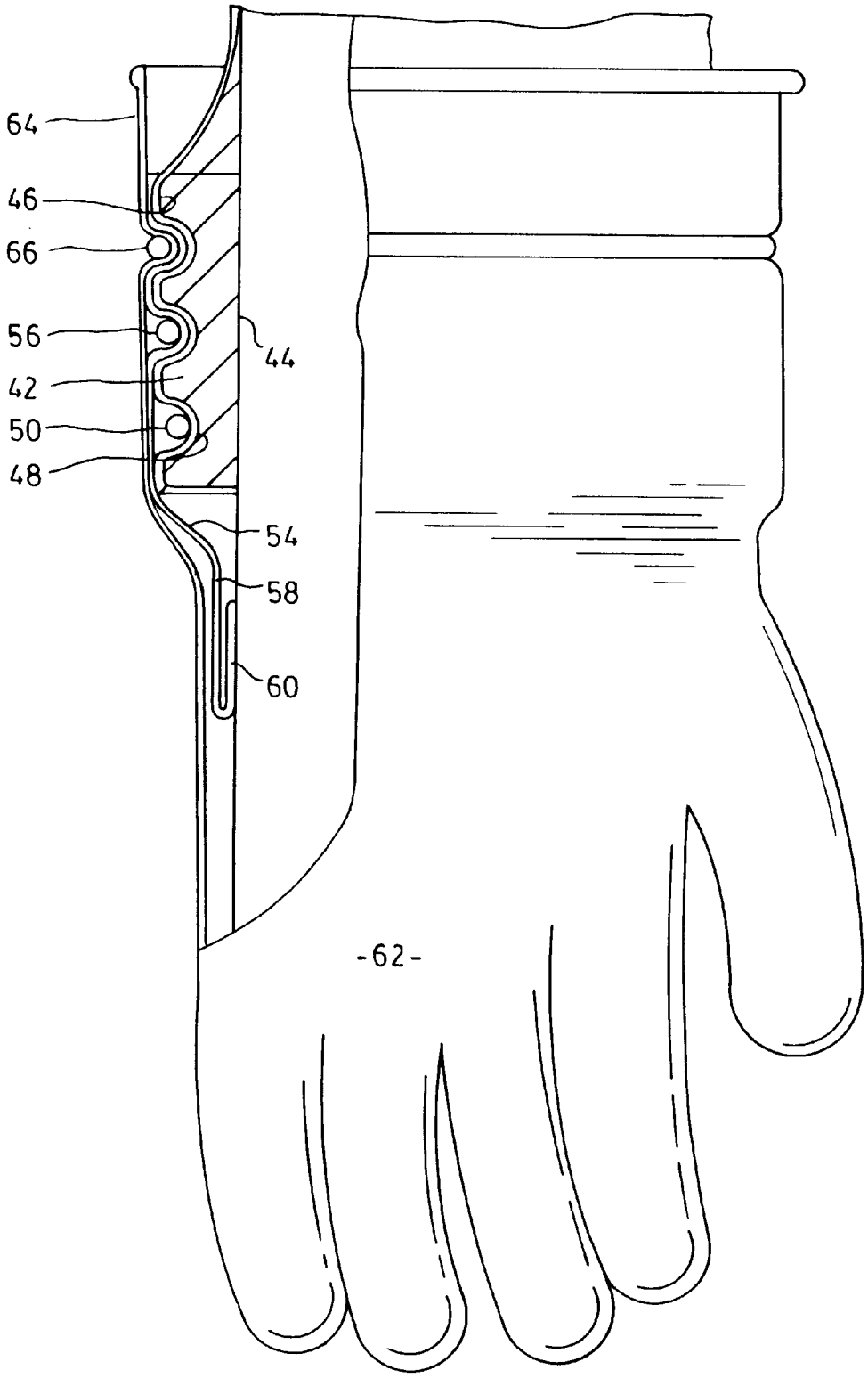
FIG. 6 is a partly section view of a glove attached to the outer garment of FIG. 1.

With the outer garment 10 installed, a seal is established between the outer garment 10 and the body portion projecting from the outer garment 10. With respect to the hands and wrist, as can be seen in FIGS. 4 and 6, a support ring 42 is provided having an inner surface 44 and an outer surface 46. The inner surface 44 is dimensioned such that the hand of the intended user may comfortably pass through the ring 42 and the ring 42 is preferably made from a self supporting plastic material having a limited degree of resilience. The outer surface 46 of the ring 42 is formed with a number of circumferential grooves 48 that are axially spaced on the outer surface 46. The grooves 48 are semicircular and are dimensioned to receive one or more layers of the outer garment 10.

The distal end of arm 18 is adjusted in diameter so as to pass over of the outer surface 46 but in a snug engagement with it. A resilient O-ring 50 with a thumb loop 52 formed on it is passed over the distal end of the arm 18 so as to be aligned with the axially outer of the grooves 48. The ring 50 thus forces the arm 18 into the groove 48 to retain it on the support ring 42.

A cuff 54 formed from a resilient flexible material is stretched over the outer surface 48 so as to overlap the distal end of the arm 18. An O-ring 56 is positioned over an intermediate one of the grooves 48 so as to force the cuff 54 into the groove 48 and into engagement with the arm 18.

The cuff 54 has a reduced diameter collar 58 that projects beyond the ring 42 and snugly engages the wrist of the user. The terminal portion of the collar 58 is folded back upon itself as indicated at 60 in FIG. 6 to provide a rolling seal that inhibits chafing as the wrist is moved. The cuff 54 thus provides a seal against the wrist of the user and inhibits the ingress of water past the wrist and into the under garment.

Further protection may be provided to the user by means of a mitt or gloved indicated at 62. The mitt or glove 62 is appropriately shaped for the hand of the user and may self insulated or may be dimensioned to fit over gloves worn by the user. A sleeve 64 extends rearwardly from the glove 62 so as to overlap the outer surface 46. A retaining ring 66 is therefore positioned over the axially inner groove 48 to bias the sleeve 64 against the cuff 54 and distal end of the arm 18.

It will be appreciated that a similar arrangement may be utilized to secure boots to the leg 16 in a sealed arrangement.

Figure 7:
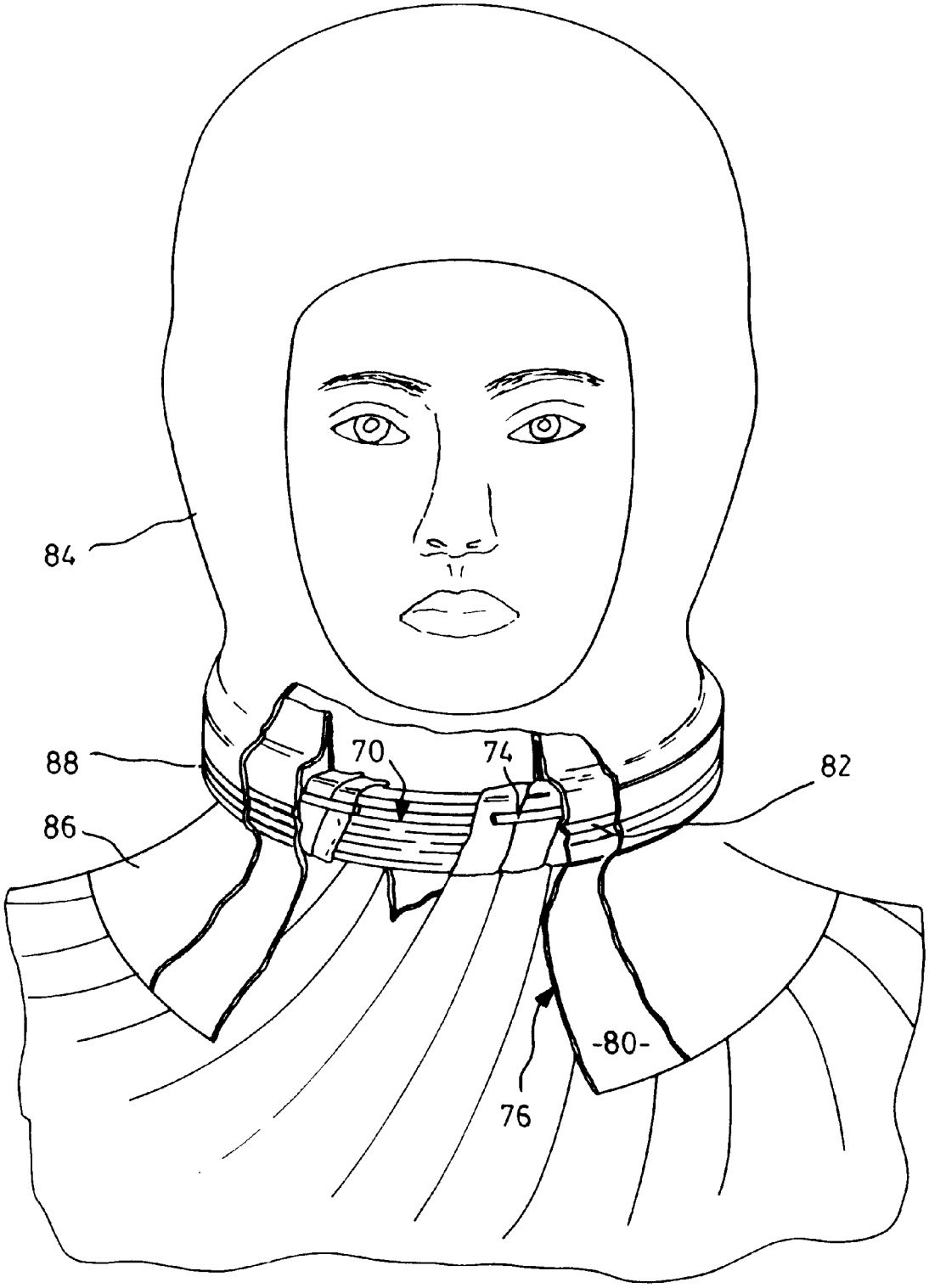
FIG. 7 is a view, partly broken away, of a hood secured to the outer garment.
Figure 8:
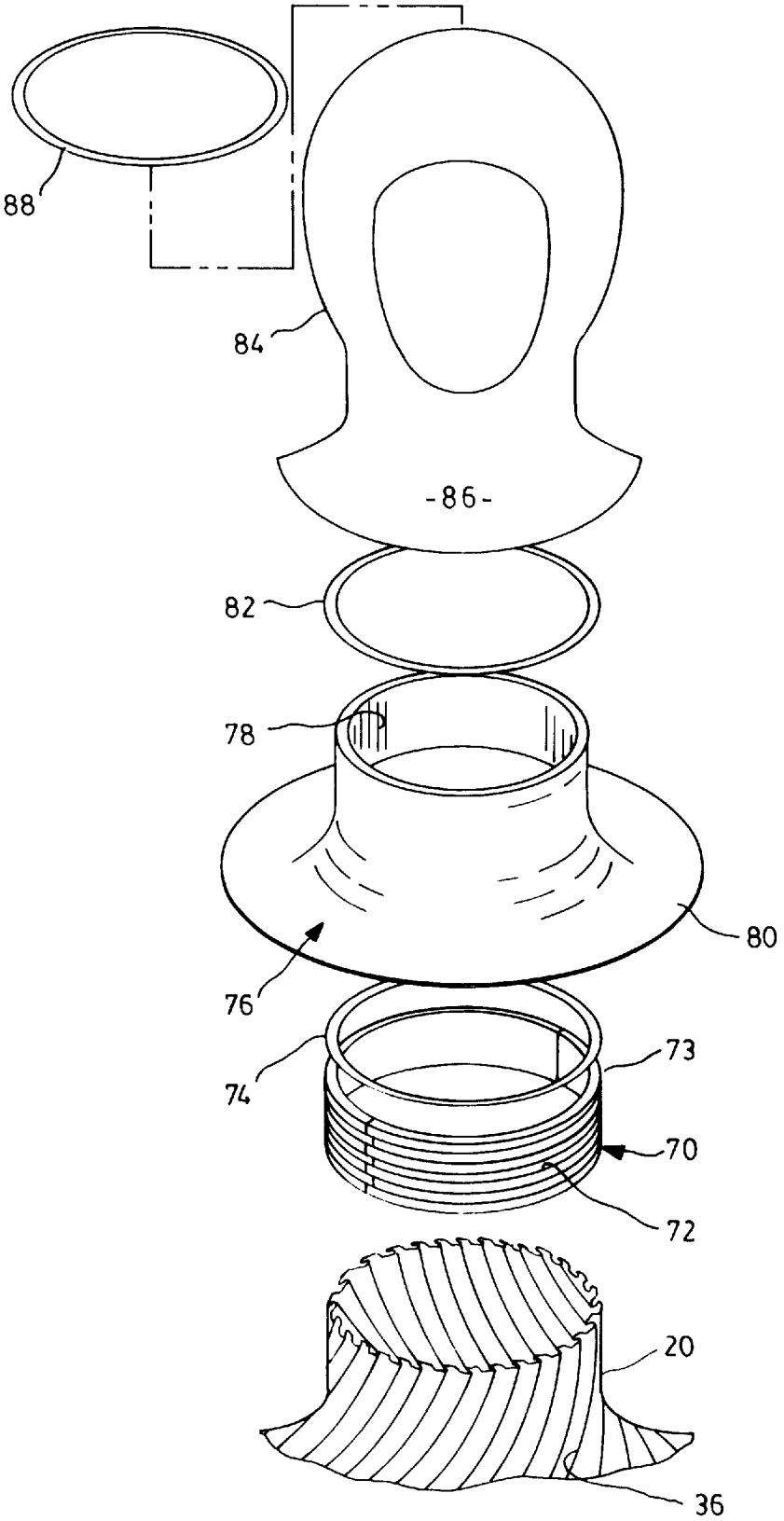
FIG. 8 is an exploded view of the components used to seal the hood and neck of the outer garment.
Figure 9:
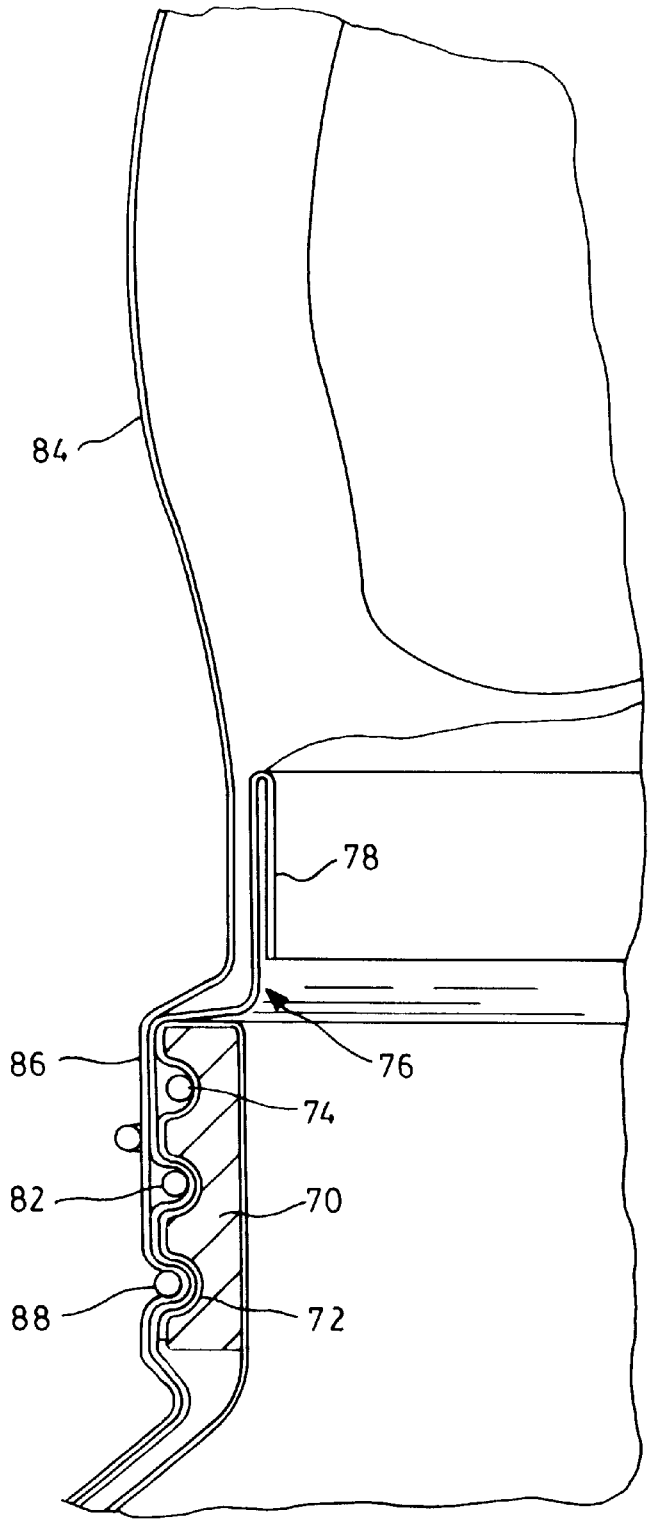
FIG. 9 is a sectional view of the installation shown in FIG. 7.

A similar arrangement is provided at the neck opening as indicated at FIGS. 7, 8 and 9. A support ring 70 is dimensioned so as to be able to pass over the head of the user and over the pleated neck opening 20. The ring 70 has a plurality of axially spaced grooves 72 on its outer surface 73 and, as can be seen from FIG. 7, the pleated neck opening 20 is folded down over the ring 70 so as to overlie the grooves 72. A resilient retaining ring 74 is then positioned over the axially outer groove 72 to force the pleated neck opening into the groove 72.

A cuff 76 formed of a flexible resilient material has an inner collar 78 that engages the neck of the user and an outer flared body 80 that extends over the pleated neck opening 20. The body 80 extends over the ring 70 and a retaining ring 82 is positioned over groove 72 to retain the cuff 76 in sealing engagement with the ring 70.

A hood 84 with a neck covering 86 is then put on with the neck covering 86 overlying the ring 72 and the body 80 of the cuff 76. A retaining ring 88 is then located over the groove 72 of the ring 70 to form the seal.

The seal provided by the support rings 42, 70 ensures that the outer garment may be put on without stretching of the cuffs at the openings in the outer garment. Once the outer garment is properly adjusted, the support rings may be inserted and effective seals provided at those locations with the cuffs. Should a cuff become worn or torn it is simply necessary to replace the cuff without having to have the outer garment 10 repaired.

The enlarged neck opening provides easy access to the outer garment and avoids the use of an expensive zipper. If necessary, access ports in the garment may be provided by a detachable plug that can be sealed with a screw thread or O-ring as appropriate.

The support rings 42,70 shown in FIGS. 4 and 7 are dimensioned to allow the hand or head to pass through them. An alternative arrangement permitting a more snug fit is shown in FIGS. 10 and 11.

The support ring 42*a* is formed from two semi-circular bands 90,92 that are pivotally connected by a pin 94. The outer surface 46*a* of the bands 90,92 is provided with aligned grooves 48*a*. The bands 90,92 have opposed radial end faces 96,98 respectively that abut in a closed position. Circumferential alignment of the grooves 48*a* is maintained by a pair of dowels 100 projecting from the end face 96 and received in holes 102 in the end face 98.

Figure 10:
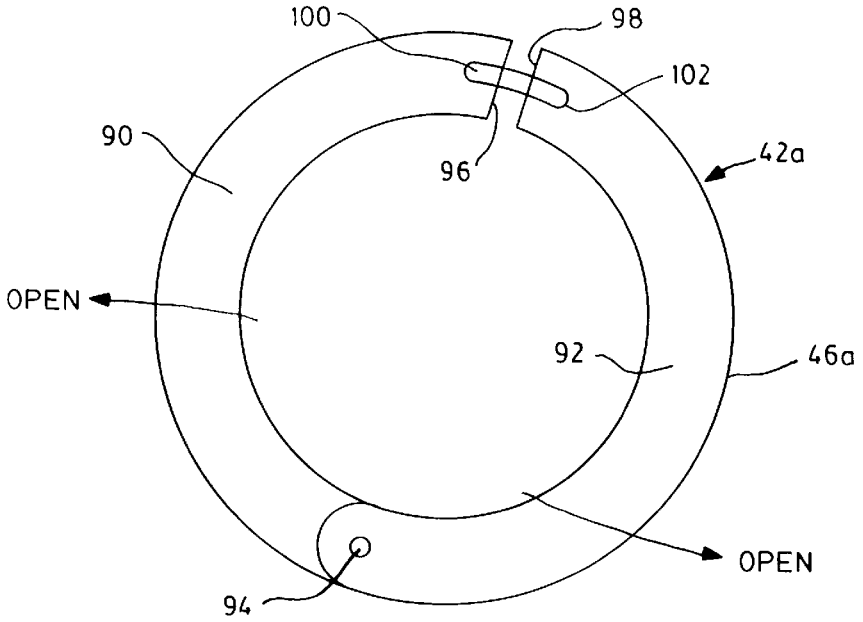
FIG. 10 is a top view of an alternative embodiment of seal arrangement.
Figure 11:
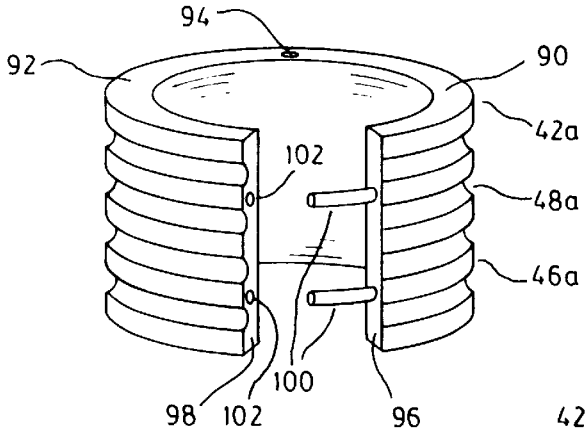
FIG. 11 is a perspective view of the component of FIG. 10 showing it in a partly open position.

As indicated in FIG. 10, the bands may pivot about pin 94 from a closed to an open position to be placed about the wrist of the user and then closed to provide a sealing surface.

Figure 12:
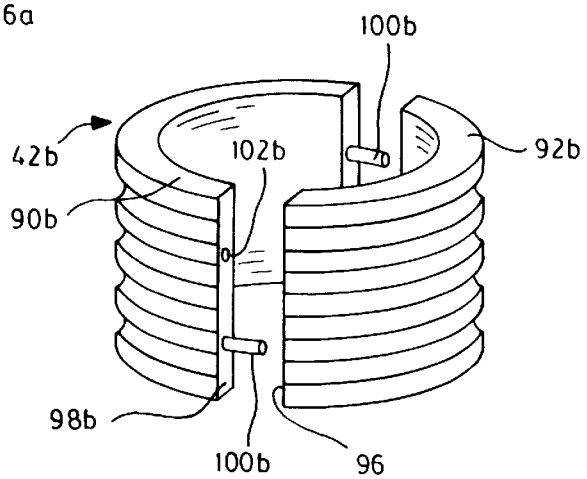
FIG. 12 is a perspective view similar to FIG. 11 of a further embodiment of seal component.

A further arrangement of support ring 42 is shown in FIG. 12 where like reference numerals will be used to indicate like components with a reference 'b' added for clarity. In the embodiment of FIG. 12, bands 90*b*,92*b* are symmetrical and each has a dowel 100*b* projecting from the respective end face 96*b*,98*b*. Each end face has a hole 102*b* to receive the dowel 100*b* from the opposite one of faces 96*b*,98*b*. The bands 90*b*,92*b* may then be slipped around the wrist of the user and connected to one another. The radial force of the O rings 50 maintains the bands in situ during use.

It will of course be appreciated that a similar arrangement may be provided at the neck support ring 70.

I claim:

1. An outer garment for a dry suit comprising a plurality of tubular portions interconnected to define a body, arms and legs for said suit, at least one of said tubular portions having a closure system including a tape of hooks and a tape of loops, said tapes being disposed parallel to one another and to the longitudinal axis of said tubular portion, each tape having a lateral extent and being engageable with one another by overlapping a portion of the lateral extent of one tape with the other tape to establish a pleat and thereby reduce the diameter of said one tubular member.

2. A garment according to claim 1 wherein a tubular neck opening extends from said body, said neck opening having pleats therein to reduce the circumference thereof.

3. A garment according to claim 2 wherein support straps are secured to said body.

4. A garment according to claim 1 wherein each of said tubular portions has a pair of tapes secured thereto to permit adjustment of each of said body, arms and legs.

5. A dry suit having an outer garment formed from a plurality of tubular portions interconnected to define a body, arms and legs for said suit, a seal provided at distal ends of said arms and legs to inhibit ingress of water thereto, a neck opening connected to said body and having a continuous tubular wall of diameter corresponding to that of said body to allow ingress of a user therethrough, said wall being pleated to provide a progressively reducing diameter away from said body.

6. A dry suit according to claim 5 wherein said pleats are triangular.

7. A dry suit according to claim 5 wherein straps are secured to said body to fit over shoulders of said user and support said garment.

* * * * *